United States Patent [19]

Anderson

[11] 4,260,395

[45] Apr. 7, 1981

[54] SYNTHETIC FUEL COMPOSITION

[76] Inventor: Timothy J. Anderson, 123 1/2 Holland Ave., Westover, W. Va. 26505

[21] Appl. No.: 25,609

[22] Filed: Mar. 30, 1979

Related U.S. Application Data

[63] Continuation-in-part of Ser. No. 893,640, Apr. 3, 1978, Pat. No. 4,169,711.

[51] Int. Cl.[3] ..... C10L 5/12

[52] U.S. Cl. ..... 44/16 C; 44/17; 44/20; 44/26

[58] Field of Search ..... 44/10 R, 16 C, 16 E, 44/17, 20, 24, 26

[56] References Cited

U.S. PATENT DOCUMENTS

| | | | |
|---|---|---|---|
| 367,015 | 7/1887 | Wandrey et al. | 44/26 |
| 417,362 | 12/1889 | Morris | 44/26 |
| 446,505 | 2/1891 | Baker | 44/26 |
| 1,668,643 | 5/1928 | Hart | 44/26 X |
| 1,995,366 | 3/1935 | Snell | 44/26 |
| 3,068,080 | 12/1962 | Ronzio | 44/17 |

*Primary Examiner*—Carl F. Dees
*Attorney, Agent, or Firm*—Armstrong, Nikaido, Marmelstein & Kubovcik

[57] ABSTRACT

A composition useful as a synthetic fuel for fireplaces and the like. The composition contains particulate coal as the major component in combination with slack wax, sodium and/or potassium silicate and an oxidizing agent. Minor amounts of coloring agents or agents for providing desired aromas or the like are optionally included in the composition. The composition is conveniently provided in the form of a log which can be used as a synthetic fuel. The composition burns slowly and evenly without excessive smoking while substantially retaining its original shape thereby facilitating removal of the resultant ashes.

7 Claims, No Drawings

SYNTHETIC FUEL COMPOSITION

This application is a continuation-in-part of copending application Ser. No. 893,640, filed Apr. 3, 1978 now U.S. Pat. No. 4,169,711.

BACKGROUND OF THE INVENTION

1. Field of the Invention

The present invention relates to synthetic fuel compositions and, more particularly, to coal-containing compositions having a preferred utility as artificial logs for fireplaces.

2. Description of the Prior Art

During the 1970's, artificial logs for fireplaces have gained tremendous popularity and a large number of such ersatz logs are commercially available. The commercially available logs are generally composed primarily of approximately equal amounts of wood particles or chips and slack wax and minor amounts of organic binders, combustion aids, coloring agents, etc. The compositions of these synthetic fuel logs are believed to be similar to the preferred composition described in Eyre, Jr., U.S. Pat. No. 3,297,419, which contains, by weight: 42% sawdust; 48% slack wax; 5% Orzan A, a lignin product identified as ammonium lignin sulfonates and wood sugars; and 5% sodium nitrate.

Artificial logs produced from coal are also available on the market. These logs, however, also contain large amounts of slack wax and during burning fail to retain their original shape. As a result, the coal particles are not sufficiently ignited and the ash remaining after burning of the log contains substantial amounts of unburned coal. Thus, inefficient use is made of the thermal energy available in the coal and removal of the ashes following burning is inconvenient.

It is an object of the present invention, therefore, to provide an economical synthetic fuel composition which contains coal as a major component and which efficiently utilizes the energy available in the coal.

It is a further object of the invention to provide a coal-containing synthetic fuel composition which can be formed into artificial logs and which burns efficiently and substantially retains its original shape.

These and other objects will be apparent from the following description of the invention.

SUMMARY OF THE INVENTION

The synthetic fuel composition according to the present invention contains at least about 40% by weight of coal particles and from about 5 to about 35% by weight of slack wax, the remainder of the composition being an alkali metal silicate binder and an oxidizing agent and, optionally, coloring agents or the like. In preferred embodiments, the composition comprises at least about 70% by weight of coal and less than about 15% by weight of slack wax.

The composition can be formed into artificial logs by any suitable molding means and is conveniently formed into cylindrically shaped logs by extrusion.

DESCRIPTION OF PREFERRED EMBODIMENTS

There do not appear to be any particular limitations regarding the type of coal that can be used in preparing the synthetic fuel composition according to the present invention. Both metallurgical and non-metallurgical grades of coal can be employed. The coal should not have a high moisture content or be highly absorbent since this may interfere with mixing of the coal with the aqueous alkali silicate employed in preparing the composition. The coal is employed in particulate form to provide a large surface area for combustion. The particles should not be so fine as to cause dusting problems or so large as to cause possible damage to mixing and extruding equipment or be difficult to handle. Mixtures of coal fines of from 0–200 mesh (Tyler) and particles of up to ½-inch diameter have been found to provide acceptable results in preparing cylindrically shaped logs by extrusion techniques. The coal particles comprise at least about 40% by weight and up to about 90% by weight of the synthetic fuel composition. In preferred compositions the coal is employed in an amount of at least about 70% by weight.

Any of the so-called slack waxes that are usually employed in preparing the conventional sawdust/wax logs are believed to be useful in the present invention. These waxes are crude petroleum products which are not completely deoiled and are available in a number of grades and qualities. The wax, of course, must have sufficient stiffness at room temperature to permit handling and to retain the desired shape of the composition. Furthermore, it should be easily ignited with a match and at the same time not melt during burning. The oil content should be such that the wax does not produce large amounts of smoke. Waxes of this type are available in the petroleum industry and are prepared in a known manner to fit individual requirements by blending of so-called low temperature elements, i.e., waxes, and high-temperature elements.

The slack wax is employed in an amount ranging from about 5% to 35% by weight of the composition. An amount of the wax of about 5% by weight is required to impart sufficient ignition and flame spreading characteristics to the composition. Use of an amount of the wax of greater than about 35% by weight is not economical and provides no additional beneficial properties. The slack wax provides lubrication when the synthetic fuel composition is extruded to form artificial logs. An amount of the wax of up to about 15% by weight has been found to provide sufficient lubrication and, at the same time, to provide an optimum balance between the cost of producing an artificial log and the burning properties thereof.

The third component of the synthetic fuel composition according to the present invention is an alkali metal silicate binder. More specifically, the binder is a soluble silicate, i.e., sodium silicate or potassium silicate. These silicates are employed as aqueous solutions which are available in a wide range of percent solids, $SiO_2/Na_2O$ or $SiO_2/K_2O$ ratios and viscosities. Typically, the percent solids will vary between about 30 to 50% and the silicate ratios will vary between about 1.8 to 3.75. The choice of a suitable silicate is believed to be limited only by its handling and mixing characteristics. If the viscosity of the aqueous silicate solution is too low, it is difficult to ensure sufficient coating of the coal particles. On the other hand, if the viscosity is too high, mixing of the silicate with the coal particles is difficult. Aqueous sodium silicate solutions having a viscosity in the range of about 1000 centipoises (measured at 65° F.) have been found to be particularly useful in preparing the compositions although mixtures of other sodium silicate solutions with potassium silicate solutions are believed to be suitable. The aqueous silicate solution is employed in an amount of from about 2% to 10% by weight of the synthetic fuel composition. An amount of at least 2% by weight is required to ensure adequate binding of the composition before and after burning. Amounts of more than 10% by weight provide excessive amounts of moisture.

The silicate appears to function as both a low temperature and high temperature binder for the synthetic fuel composition. The silicate solution is mixed with the coal, slack wax, oxidizer and additives, if any, and formed into a desired shape. Although the silicate apparently dehydrates to some extent during these operations, it is believed that at least a significant portion of the moisture content is retained. During burning of the synthetic fuel composition, e.g., as an artificial log in a fireplace, the silicate dehydrates to provide strong, relatively rigid bonds with the components of the logs. This setting, or hardening, of the silicate enables the synthetic fuel composition to substantially retain its original shape during burning (the silicate is not combustible) and provides for easy removal and disposal of the resultant ashes. The silicate also operates to control the amount of smoke given off by the composition during burning.

The fourth essential component of the coal-containing synthetic fuel composition of the invention is an oxidizer, or combustion or ignition aid. The oxidizer promotes combustion and increases the temperature during burning of the composition to ignite the coal particles. Any of the commonly known combustion promoters or ignition accelerators can be employed in the present invention. Preferred are the nitrates, perchlorates, peroxides and permanganates. Sodium and/or potassium nitrate are particularly preferred because of their availability and cost. An amount of oxidizer of about 5% to 15% by weight of the composition is suitable for most purposes.

The synthetic fuel composition of the invention may also contain other components which add to the aesthetic features of the composition but which do not materially affect the basic properties thereof. Thus, for example, coloring agents such as those disclosed in Brockbank, U.S. Pat. No. 4,062,655, and Pierce, U.S. Pat. No. 4,042,313, can be included in the composition. Agents which produce desirable aromas such as that of pine could also be added to the composition. These optional components can be employed in amounts of up to about a total of 5% by weight of the composition.

The synthetic fuel composition is prepared by first mixing the coal particles with the aqueous silicate solution so as to provide a thin film of the silicate on the particles. The coated particles of coal are then blended with the slack wax, which has been heated to a temperature above its melting point to liquefy it, and the oxidizer and other additives, if any. The composition is then formed into a desired shape by conventional molding and forming techniques.

In a particularly preferred embodiment according to the present invention, the synthetic fuel composition is extruded in a substantially cylindrical form to provide log-shaped members suitable as artificial logs for fireplaces. This embodiment will be further illustrated by way of the following example.

EXAMPLE

In this example, the following components are employed (all parts and percentages are by weight unless otherwise specified):

(1) Coal-crushed, bituminous, non-metallurgical grade of coal having a maximum particle size of about ½ inch;

(2) Soluble silicate—an aqueous solution of sodium silicate having an $SiO_2/Na_2O$ ratio of 2.88, a solids content of 42.7% and a viscosity of 960 poise (at 65° F.);

(3) Slack wax—wax having a melting point of 121.5° F., flash point of 405° F., oil content (ASTM) of 6.5%, viscosity (SUS) of 37.6 and a penetration (77 needle) of 94; and (4) Oxidizer—a mixture of potassium and sodium nitrate.

The coal and aqueous sodium silicate solution are added to a mixer in amounts of 71.4 parts and 5.7 parts, respectively, and are blended until a thin film of the silicate is provided on the individual particles. The oxidizer (8.6 parts) and the slack wax (14.3 parts), which has been liquefied by heating, are then added to the mixer and the mixture is thoroughly blended to provide a uniform mixture. The mixture is then allowed to cool to below the melting point of the wax, for example, to about 90° F., and is then fed to an extruder. A suitable extruder is a Bonnot Lumberjack extruder manufactured by the Bonnot Company, Kent, Ohio. The mix is forced by the pressure of the screw of the extruder through a log forming die having about a 4 inch diameter opening to produce substantially cylindrical logs which are then cut to the desired length and packaged. A 7 pound log produced in this manner will burn approximately twice as long as a commercially available sawdust/wax log and will produce about twice the amount of heat. Moreover, the log does not fall apart during burning but substantially remains intact to form a shell-like mass that can be easily disposed of.

Although the invention has been described in conjunction with the foregoing preferred embodiments, it is not intended to be limited to these but, instead, includes all those embodiments within the spirit and scope of the appended claims. Thus, for example, it is believed that minor amounts of sawdust can be employed in conjunction with the coal particles without materially affecting the inventive features of the coal-containing synthetic fuel composition defined by the claims.

What is claimed is:

1. A synthetic fuel composition comprising at least about 40% by weight of coal particles, from about 5 to 35% by weight of slack wax, a binder selected from the group consisting of sodium silicate and potassium silicate and an oxidizer.

2. The synthetic fuel composition of claim 1 wherein the silicate is employed as an aqueous solution in an amount of from about 2 to 10% by weight of the synthetic fuel composition mixture.

3. The synthetic fuel composition of claim 2 wherein the oxidizer is sodium nitrate, potassium nitrate or mixtures thereof and is employed in an amount of from 5 to 15% by weight.

4. The synthetic fuel composition of claim 3 wherein the coal has a maximum particle size of about ½ inch.

5. The synthetic fuel composition of claim 4 which further comprises up to about 10% by weight of a coloring or aroma-producing additive.

6. The synthetic fuel composition according to any of claims 1–5 comprising at least about 70% by weight of the coal particles and less than about 15% by weight of the slack wax.

7. The synthetic fuel composition of claim 6 which is in the form of a log.

* * * * *